US008413864B2

(12) United States Patent
Wolf

(10) Patent No.: US 8,413,864 B2
(45) Date of Patent: Apr. 9, 2013

(54) COMBUSTION-OPERATION SETTING TOOL

(75) Inventor: Iwan Wolf, Untervaz (CH)

(73) Assignee: Hilti Aktiengesellschaft, Schaan (LI)

( * ) Notice: Subject to any disclaimer, the term of this patent is extended or adjusted under 35 U.S.C. 154(b) by 649 days.

(21) Appl. No.: 12/080,415

(22) Filed: Apr. 1, 2008

(65) Prior Publication Data

US 2008/0245837 A1 Oct. 9, 2008

(30) Foreign Application Priority Data

Apr. 4, 2007 (DE) ..... 10 2007 000 201

(51) Int. Cl.
*B25C 1/14* (2006.01)

(52) U.S. Cl.
USPC ..... 227/10; 227/9

(58) Field of Classification Search ..... 227/9, 10, 227/8; 123/46 SC; 239/585.1
See application file for complete search history.

(56) References Cited

U.S. PATENT DOCUMENTS

| | | | | |
|---|---|---|---|---|
| 4,468,431 | A * | 8/1984 | Okey | 428/317.7 |
| 4,729,360 | A * | 3/1988 | Fehrenbach et al. | 123/447 |
| 5,398,657 | A * | 3/1995 | Press et al. | 123/472 |
| 5,712,038 | A * | 1/1998 | Yamazaki et al. | 428/411.1 |
| 5,971,245 | A | 10/1999 | Robinson | |
| 6,523,860 | B1 * | 2/2003 | Deieso et al. | 285/3 |
| 6,629,650 | B2 * | 10/2003 | Curran et al. | 239/585.1 |
| 7,040,520 | B2 | 5/2006 | Turk | |
| 7,063,247 | B1 * | 6/2006 | Lund et al. | 227/10 |
| 2002/0158103 | A1 | 10/2002 | Driscoll et al. | |
| 2004/0050901 | A1 | 3/2004 | Turk | |
| 2004/0134960 | A1 * | 7/2004 | Schiestl et al. | 227/10 |
| 2004/0166296 | A1 * | 8/2004 | Ragland et al. | 428/209 |
| 2005/0247748 | A1 * | 11/2005 | Schiestl | 227/10 |
| 2006/0032886 | A1 | 2/2006 | Gschwend et al. | |
| 2006/0042571 | A1 * | 3/2006 | Panasik et al. | 123/46 H |
| 2006/0226193 | A1 | 10/2006 | Toulouse | |

FOREIGN PATENT DOCUMENTS

DE 3534095 A1 * 4/1987

* cited by examiner

*Primary Examiner* — M. Alexandra Elve
*Assistant Examiner* — Nathaniel Chukwurah
(74) *Attorney, Agent, or Firm* — Abelman, Frayne & Schwab

(57) ABSTRACT

A combustion-operated setting tool for driving in fastening elements includes a propellant container receptacle (16) for receiving a propellant container (20), a connection element (14) provided in the propellant container receptacle (16) for connection with the propellant container (20), a propellant conduit (15) for connecting the connection element (14) with the tool combustion chamber (12), a metering device (13) for controlling flow of propellant from the connection element (14) to the combustion chamber, and a damping arrangement (30) for damping the metering device (13).

9 Claims, 1 Drawing Sheet

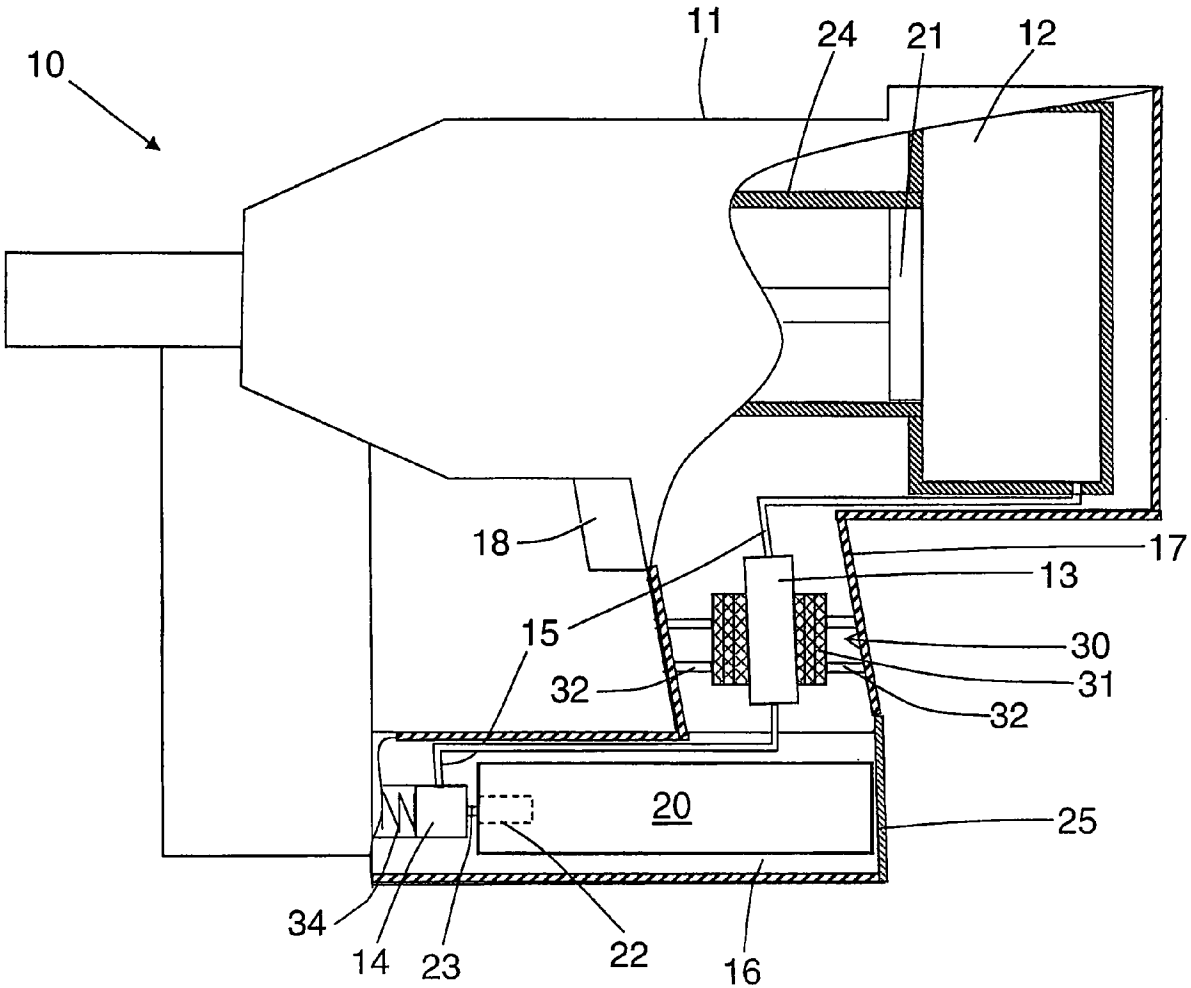
10
11
12
21
24
18
15
32
17
13
30
31
32
25
20
16
22
23
14
34

COMBUSTION-OPERATION SETTING TOOL

BACKGROUND OF THE INVENTION

1. Field of the Invention

The present invention relates to a combustion-operated setting tool for driving in fastening elements, and including a combustion chamber gaseous propellant or fuel driven by liquid or for combusting a propellant, a propellant container receptacle for replaceably receiving a propellant container, a connection element provided in the propellant container receptacle for connection with the propellant container, a propellant conduit for connecting the connection element with the combustion chamber, and a metering device for controlling flow of propellant from the connection element to the combustion chamber.

2. Description of the Prior Art

U.S. Pat. No. 6,523,860 discloses a setting tool in the housing of which, there is provided a metering device in form of a metering valve for controlling flow of fuel, and which has a receiving space for a fuel container. An adapter that can be pinned on the valve head of the fuel container, is connectable with a connector, which is provided in the receiving space, for insuring a releasable arrangement of the fuel container in the receiving space and for connecting the connector with the metering valve.

The drawback of the known setting tool consists in that during operation of the setting tool, rebound pulses act on the metering valve and which adversely affect the function and the service life of conventional electronically controlled valves.

Accordingly, an object of the present invention is to provide a setting tool of the type discussed above in which the above-discussed drawbacks are eliminated and a disturbance-free use of conventional electronically controlled valve is possible.

SUMMARY OF THE INVENTION

This and other objects of the present invention, which will become apparent hereinafter, are achieved by providing, in a setting tool of the type discussed above, a damping arrangement for dampingly supporting a metering device in the setting tool. The damping arrangement damps impacts and accelerations which take place during operating of the setting tool, and prevents a direct action of impacts and acceleration on a metering device, e.g., an electronically controlled valve, minimizing their action on the metering device. The damping arrangement prevents disturbances in operation of the metering device and, thus, enables use of conventional and, thereby, economical electrically controlled valve such as, e.g., pilot valves used in pneumatic control.

Advantageously, the damping arrangement includes a support element supported against a setting tool housing and a damping member provided between the metering device and the support element.

The support element can be formed by projections or webs forming an integral part of the tool housing. The damping member can be formed, e.g., as an elastomeric body having good damping characteristics. This arrangement can be built into existing constructions.

Advantageously, the damping member is formed of a damping foil that can be produced as an economical standard element. Alternatively, the damping member can be formed, e.g., as a foam part.

Advantageously, the damping member consists of several layers of the damping foil. Thereby, the number of layers of the damping foil can be adapted to a power class of a setting tool, insuring an adequate damping. A desired damping can also be achieved with only a single layer of the damping foil, dependent on the type of the damping foil.

It is advantageous, when a section of the propellant conduit between the connection member and the metering device is formed flexible at least regionwise. In this case, the metering device is held in the propellant conduit not stationary but displaceably, which is advantageous for damping purposes.

Advantageously, the propellant conduit is formed as an elastically deformable metallic tubular conduit that is particularly pressure-resistant and is very suitable for liquid fuel gases.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

Single FIGURE of the drawings shows a side, partially cross-sectional view of the combustion-operated setting tool according to the present invention.

DETAILED DESCRIPTION OF THE PREFERRED EMBODIMENT

A hand-held setting tool 10 according to the present invention, which is shown in the drawing and is driven by a propellant in form of liquid or gaseous fuel includes a propellant container receptacle 16 in which a propellant container 20 is located.

The setting tool has a housing 11 with a handle 17 formed thereon. An actuation switch 18, with which a setting process can be initiated, is provided on the handle 17. The setting tool 10 further includes a setting mechanism having a combustion chamber 12 for combusting an air-propellant mixture, and a setting piston 21 displaceable in a guide 24. As it has already been mentioned above, a propellant container 20, which is formed as a gas bottle in the embodiment of the setting tool 10, shown in the drawing, is located in propellant container receptacle 16 provided in the setting tool 10. The propellant container 20 is inserted in an opening, which is closed with a cover 25. The propellant container 20 is provided at one of its ends with a valve outlet 23 of a valve 22, e.g., a stem. Through the valve outlet 23, a propellant can flow out of the propellant container 20. To accommodate the propellant flow, a connection element 14 such as, e.g., a connection union, is provided in the propellant container receptacle 20. The connection element 14 is connectable, as shown in the drawing, with the valve outlet 23 of the propellant container 20.

The connection element 14 is elastically biased by a spring 34 in the direction of the cover 25. The spring 34, thus, presses the connection element 14 against the valve outlet 23 when the propellant container 20 is located in the propellant container receptacle 16. This insures a tight and reliable connection between the connection element 14 and the propellant container 20. In order to absorb the relative displacement between the connection member 14 and a metering device 13, which is located in the propellant conduit 15, the propellant conduit is formed partially flexible. In the shown embodiment, the entire section of the propellant conduit 15 between the connection element 14 and the metering device 13 is formed of an elastically deformable metal tube.

For absorbing rebound pulses, which act on the metering device 13, a damping arrangement 30 is provided in the housing 11. The metering device 13, which is formed as an electrically controlled metering valve, is supported by a damping member 31 against a support element 32. The support element 32 can be formed, e.g., as a housing projection, rib, web, or the like. The damping member 31 is formed, e.g., of one or more layers of a damping foil cylindrically wound to form a sleeve. Naturally, only one layer of the damping foil may suffice. Alternatively, to the damping foil, a foam member can be used as a damping member.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A combustion-operated setting tool for driving in fastening elements, comprising a housing (11), a combustion chamber (12) located in the housing for combusting a propellant; a propellant container receptacle (16) for receiving a propellant container (20); a connection element (14) provided in the propellant container receptacle (16) for connection with the propellant container (20); a propellant conduit (15) for connecting the connection element (14) with the combustion chamber (12); a metering device (13) for controlling flow of propellant from the connection element (14) to the combustion chamber; and damping means (30) for dampingly supporting the metering device (13) against action of impacts and accelerations taking place during operation of the setting tool, the damping means (30) having a damping member (31) for supporting the metering device (13), and a support element (32) extending between the damping member and the housing for supporting the damping member (31), together with the metering device, in a spaced relationship to the housing.

2. A combustion-operated setting tool according to claim 1, wherein the damping member (31) is formed of a damping foil.

3. A combustion-operated setting tool according to claim 2, wherein the damping member (31) is formed of several layers of the damping foil.

4. A combustion-operated setting tool according to claim 1, wherein a section of the propellant conduit (15) between the connection member (14) and the metering device (13) is formed flexible.

5. A combustion-operated setting tool according to claim 1, wherein the propellant conduit (15) is formed as an elastically deformable metallic tubular conduit.

6. A combustion-operated setting tool according to claim 1, wherein the metering device (13) is arranged in the propellant conduit (15) between the connection element (14) and the combustion chamber (12).

7. A combustion-operated setting tool according to claim 1, wherein the damping member (31) supports the metering device (13) in a spaced relationship with respect to the setting tool housing (11).

8. A combustion-operated setting tool according to claim 1, wherein the connection element (14) is formed as a union, and the metering device (13) is formed as a metering valve.

9. A combustion-operated setting tool for driving in fastening elements, comprising a housing (11), combustion chamber (12) located in the housing for combusting a propellant; a propellant container receptacle (16) for receiving a propellant container (20); a connection element (14) provided in the propellant container receptacle (16) for connection with the propellant container (20); a propellant conduit (15) for connecting the connection element (14) with the combustion chamber (12); a metering device (13) for controlling flow of propellant from the connection element (14) to the combustion chamber; a damping member (31) for dampingly supporting the metering device (13) against action of impacts and accelerations taking place during operation of the setting tool; and a support element (32) extending between the damping member and the housing for supporting the damping member (31), together with the metering device, in a spaced relationship to the housing.

* * * * *